US009003748B2

(12) United States Patent
Hosoda et al.

(10) Patent No.: US 9,003,748 B2
(45) Date of Patent: Apr. 14, 2015

(54) COIN PROCESSING UNIT

(75) Inventors: Jyun Hosoda, Himeji (JP); Kousaku Kayahara, Himeji (JP); Keiji Nakamura, Himeji (JP)

(73) Assignee: Glory Ltd., Himeji-Shi, Hyogo (JP)

( * ) Notice: Subject to any disclaimer, the term of this patent is extended or adjusted under 35 U.S.C. 154(b) by 1015 days.

(21) Appl. No.: 12/590,380

(22) Filed: Nov. 6, 2009

(65) Prior Publication Data

US 2010/0121485 A1 May 13, 2010

(30) Foreign Application Priority Data

Nov. 6, 2008 (JP) ..... 2008-285757
Nov. 6, 2008 (JP) ..... 2008-285758

(51) Int. Cl.
*B65B 35/50* (2006.01)
*G07D 9/06* (2006.01)
*B65B 11/00* (2006.01)

(52) U.S. Cl.
CPC ..... *G07D 9/065* (2013.01)

(58) Field of Classification Search
USPC ..... 53/532, 212, 218, 531; 194/346; 453/58, 59, 60–62
See application file for complete search history.

(56) References Cited

U.S. PATENT DOCUMENTS 3,323,279 A * 6/1967 Toshihisa Matsui ..... 53/520
3,432,983 A * 3/1969 Picollo Giacomo ..... 53/52
3,748,821 A * 7/1973 Hull et al. ..... 53/532
3,757,805 A * 9/1973 Puhahn et al. ..... 453/57
3,950,921 A * 4/1976 Itoda et al. ..... 53/67
4,026,089 A * 5/1977 Murakami et al. ..... 53/77
4,102,110 A * 7/1978 Iizuka et al. ..... 53/493
4,123,892 A * 11/1978 Asami ..... 53/54
4,162,598 A * 7/1979 Watanabe et al. ..... 53/54
4,353,195 A * 10/1982 Nakamura ..... 53/54
4,383,541 A * 5/1983 Uchida ..... 453/31
4,896,481 A 1/1990 Sentoku et al. ..... 53/501
4,897,984 A * 2/1990 Sentoku et al. ..... 53/501
5,002,516 A 3/1991 Watanabe et al. ..... 453/7

(Continued)

FOREIGN PATENT DOCUMENTS

JP 4-195491 7/1992
JP 5-162711 6/1993

(Continued)

OTHER PUBLICATIONS

EPO Search Report (3 pages, dated May 18, 2010).

*Primary Examiner* — Gloria R Weeks
(74) *Attorney, Agent, or Firm* — Renner, Kenner, Greive, Bobak, Taylor & Weber

(57) ABSTRACT

A wrapping unit for wrapping and forming a predetermined number of stacked coins into a coin-roll is arranged in a lower region of a machine body. A coin storing and feeding unit and sending unit are arranged side by side in a width direction of the machine body above the wrapping unit. Thus, the machine body is downsized in its width direction.

In a state where a dispensing box attached to a dispensing box attachment unit is locked, coins are fed from the coin storing and feeding units, and the fed coins are recognized by a dispensing recognition unit, and sent to the dispensing box. If coins for dispensing sent to the dispensing box are normal coins, the dispensing box is unlocked. If an abnormal coin is recognized, a bottom plate of the dispensing box is opened. Coins dropping from the dispensing box are collected in a collection unit.

12 Claims, 10 Drawing Sheets

(56) References Cited

U.S. PATENT DOCUMENTS

| | | | | |
|---|---|---|---|---|
| 5,009,365 | A * | 4/1991 | Holtzer | 232/16 |
| 5,016,745 | A * | 5/1991 | Schoeb et al. | 194/346 |
| 5,499,483 | A * | 3/1996 | Oikawa | 53/53 |
| 5,941,364 | A * | 8/1999 | Wei | 194/350 |
| 6,082,519 | A * | 7/2000 | Martin et al. | 194/350 |
| 6,186,310 | B1 * | 2/2001 | Waldecker et al. | 194/346 |
| 6,209,294 | B1 * | 4/2001 | Hibari | 53/493 |
| 6,385,944 | B1 * | 5/2002 | Taniguchi et al. | 53/168 |
| 6,409,589 | B1 * | 6/2002 | Laconico et al. | 453/17 |
| 6,497,085 | B2 * | 12/2002 | Fukumoto et al. | 53/501 |
| 6,499,277 | B1 * | 12/2002 | Warner et al. | 53/447 |
| 6,607,063 | B2 * | 8/2003 | Kuwabara et al. | 194/346 |
| 6,626,752 | B2 * | 9/2003 | Zimmermann et al. | 453/59 |
| 6,629,885 | B1 * | 10/2003 | Tsuruda et al. | 453/3 |
| 6,733,380 | B1 * | 5/2004 | Kohls et al. | 453/59 |
| 6,772,870 | B2 * | 8/2004 | Sugai et al. | 194/217 |
| 6,880,825 | B2 * | 4/2005 | Seelig et al. | 273/143 R |
| 7,677,443 | B2 * | 3/2010 | Ireland et al. | 235/379 |
| 7,698,880 | B2 * | 4/2010 | Kasahara et al. | 53/500 |
| 7,975,910 | B2 * | 7/2011 | Artino et al. | 235/379 |
| 7,975,911 | B2 * | 7/2011 | Artino et al. | 235/379 |
| 8,096,465 | B2 * | 1/2012 | Lebeau | 232/15 |

FOREIGN PATENT DOCUMENTS

| | | | |
|---|---|---|---|
| JP | 2512271 | 7/1996 | B65B 61/28 |
| JP | 2756882 | 3/1998 | B65B 11/56 |
| JP | 11-283073 | 10/1999 | G07D 9/00 |
| JP | 2005-228080 | 8/2005 | G07D 9/00 |

* cited by examiner

COIN PROCESSING UNIT

INCORPORATION BY REFERENCE

The present invention claims priority under 35 U.S.C. §119 to Japanese Patent Application Nos. 2008-285757 and 2008-285758 filed on Nov. 6, 2008 and Nov. 6, 2008 and Mar. 16, 2009, respectively. The contents of these applications are incorporated herein by reference in their entirety.

FIELD OF THE INVENTION

The present invention relates to a coin processing unit for processing coins and coin-rolls each of which is formed by stacking and wrapping a predetermined number of coins.

Additionally, the present invention relates to a coin processing unit for dispensing coins.

BACKGROUND OF THE INVENTION

As a cash depositing and dispensing machine used in financial institutions, etc., a coin processing unit for processing coins and coin-rolls, each of which is wrapped coins formed by stacking and wrapping a predetermined number of coins, has been conventionally used.

In the coin processing unit, coins put in a machine body are received and recognized in a coin receiving and processing unit, and coins recognized as normal coins are escrowed in a depositing escrow unit (escrow unit) and stored in denomination-specific coin storing and feeding units by storage operation. Coins stored in the coin storing and feeding unit can be fed one by one and used for dispensing. Additionally, coins fed one by one from the coin storing and feeding unit are formed into a coin-roll by being fed to a wrapping unit arranged in the machine body and stacked and wrapped in a predetermined number, and the coin-roll can be stored in a coin-roll storing and sending unit arranged in the machine body, and fed and dispensed from the coin-roll storing and sending unit.

In such coin processing units, as disclosed in, for example, Japanese Laid-Open Patent Publication No. 2005-228080, the coin receiving and processing unit is arranged in an upper region in the machine body, the depositing escrow unit is arranged under the coin receiving and processing unit, the coin storing and feeding unit is arranged under the depositing escrow unit, the wrapping unit is arranged aside of the coin storing and feeding unit, and the coin-roll storing and sending unit is arranged above the wrapping unit. That is, in a lower region of the machine body, the coin storing and feeding unit and the wrapping unit are arranged side by side in a width direction of the machine body when viewed from a front face side of the machine body.

On the other hand, the coin processing unit is relatively large in its width direction, thereby causing one reason for hindering the introduction thereof in a small scale financial institution, etc. Therefore, a coin processing unit has been required which has a relatively small size in its width direction.

However, it is difficult to downsize the machine body of the conventional coin processing unit in its width direct ion, because the wrapping unit is required to have a size in the width direction relatively larger than those of the coin storing and feeding unit and the coin-roll storing and sending unit and thus the wrapping unit and the coin storing and feeding unit are arranged side by side in the width direction of the machine body.

Additionally, since the wrapping unit and the coin storing and feeding unit are arranged side by side in the width direction of the machine body, in order to send coins in the coin storing and feeding unit to the wrapping unit, some kind of route for transporting coins in the coin storing and feeding unit upward and sending them to the wrapping unit is required, and therefore downsizing of the machine body in its width direction is hindered.

The present invention has been made in view of the above problem, and it is a first object of the present invention to provide a coin processing unit having a machine body small in its width direction.

Additionally, in the conventional coin processing unit for dispensing coins, as disclosed in, for example, Japanese Laid-Open Patent Publication No. 2005-228080, at the time of dispensing coins, coins for dispensing are fed from denomination-specific coin storing and feeding units storing coins of dispensing denominations, sent by a transport unit to a dispensing escrow unit (transport box) to be escrowed therein, the dispensing escrow unit is moved to a dispensing box (loose coins dispensing box) after receiving the coins for dispensing by the dispensing escrow unit, the coins in the dispensing escrow unit are ejected to the dispensing box, the dispensing box is detached from the machine body, and the coins are taken out from the dispensing box. Additionally, at the time of collecting coins from the coin storing and feeding unit, coins are fed from the coin storing and feeding unit in a state where a bottom plate of the dispensing escrow unit is opened, and the fed coins are sent by the transfer unit to the dispensing escrow unit and made to pass through the dispensing escrow unit to be collected in the collection unit.

However, the conventional coin processing unit is large in size and increases the cost, because a dispensing escrow unit, a moving mechanism for moving the dispensing escrow unit and a space for movement of the dispensing escrow unit are required for sending coins in the coin storing and feeding unit to the dispensing box at the time of dispensing coins.

Further, an abnormal coin such as a coin of a different denomination has the possibility of being sent to the dispensing box and dispensed when being mixed in coins for dispensing due to, for example, storage of the coin in the coin storing and feeding unit.

The present invention has been made in view of the above problem, and it is a second object of the present invention to provide a coin processing unit which can realize downsizing and cost reduction, shorten the processing time for dispensing coins, and prevent the dispensing box containing an abnormal coin from being taken out.

SUMMARY OF THE INVENTION

A coin processing unit for processing coins of the present invention includes: a machine body; a wrapping unit which is arranged in a lower region in the machine body, and wraps and forms a predetermined number of stacked coins into a coin-roll; a coin storing and feeding unit which is arranged above the wrapping unit, and is capable of storing coins, which are received in the machine body, by denomination and feeding the stored coins to the wrapping unit; and a coin-roll storing and sending unit which is arranged above the wrapping unit, and is capable of storing and sending coin-rolls formed by the wrapping unit. Since the wrapping unit is thus arranged in the lower region in the machine body and the coin storing and feeding unit and the coin-roll storing and sending unit are thus arranged above the wrapping unit, the machine body can be downsized in its width direction. Further, no route for transporting coins in the coin storing and feeding unit upward and sending them to the wrapping unit is required, contributing to downsizing of the machine body in its width direction.

The coin storing and feeding unit is arranged along a depth direction of the machine body side by side by denomination. The coin-roll storing and sending unit aligns and stores a plurality of coin-rolls along the depth direction of the machine body. These coin storing and feeding unit and coin-roll storing and sending unit are arranged side by side in the width direction of the machine body. Since the coin storing and feeding unit is thus arranged along the depth direction of the machine body side by side by denomination and the coin-roll storing and sending unit thus aligns and stores a plurality of coin-rolls along the depth direction of the machine body, the machine body can be downsized in the width direction even if the coin storing and feeding unit and the coin-roll storing and sending unit are arranged side by side in the width direction of the machine body.

The coin storing and feeding unit includes a coin storing unit for storing coins and a coin feeding unit each for feeding coins from a lower part of the coin storing unit. In the coin storing and feeding unit, coins are thus fed from the a lower part of the coin storing unit storing the coins and sent to the wrapping unit located under the storing units, and thus can be processed in the direction of gravity, and the processing speed can be improved.

A coin-roll transport unit for transporting coin-rolls formed by the wrapping unit to the coin-roll storing and sending unit is provided in front of the wrapping unit and the coin-roll storing and sending unit. Coin-rolls formed by the wrapping unit can be thus transported to the coin-roll storing and sending unit by the coin-roll transport unit arranged in front of the wrapping unit and the coin-roll storing and sending unit, and thus can be promptly stored in the coin-roll storing and sending unit compared with, for example, the case of being laterally transported and stored, and the processing speed can be improved.

There are provided: a coin receiving and processing unit which is arranged in an upper region in the machine body, and recognizes coins received from the outside of the machine body; and a depositing escrow unit which is arranged under the coin receiving and processing unit and above the coin storing and feeding unit, escrows coins recognized by the coin receiving and processing unit and ejects the escrowed coins to the coin storing and feeding unit for storing. Since the coin receiving and processing unit is thus arranged in the upper region in the machine body and the depositing escrow unit is thus arranged under the coin receiving and processing unit and above the coin storing and feeding unit, the coin receiving and processing unit, depositing escrow unit, coin storing and feeding unit and wrapping unit are vertically aligned and the machine body can be downsized in its width direction.

The wrapping unit includes: a centrifugal disk for wrapping for receiving coins, which are fed from the coin storing and feeding unit, and feeding the received coins one by one; a coin passage for wrapping for transporting coins fed one by one from the centrifugal disk for wrapping; a stacking unit for successively stacking coins, which are transported through the coin passage for wrapping, upward; and a wrapping mechanism for wrapping and forming a predetermined number of coins, which are stacked in the stacking unit, into a coin-roll. Since a predetermined number of coins are thus successively stacked upward in the stacking unit of the wrapping unit and wrapped, a space vertically required can be made small and the coin processing unit can be downsized compared with the case where a predetermined number of coins are successively stacked downward and moved further downward to be wrapped.

The centrifugal disk for wrapping of the wrapping unit is arranged under the coin storing and feeding unit, and the stacking unit and the wrapping mechanism are arranged under the coin-roll storing and sending unit. Since the centrifugal disk for wrapping of the wrapping unit is thus arranged under the coin storing and feeding unit and the stacking unit and the wrapping mechanism are thus arranged under the coin-roll storing and sending unit, a coin route for sending coins in the coin storing and feeding unit to the centrifugal disk for wrapping and a route for storing coin-rolls, which are formed by the stacking unit and wrapping mechanism, in the coin-roll storing and sending unit can be simplified in constitution and the coin processing unit can be downsized.

Additionally, a coin processing unit for processing coins of the present invention includes: a coin storing and feeding unit capable of storing and feeding coins; a transport unit for transporting coins fed from the coin storing and feeding unit; a dispensing recognition unit for recognizing coins transported by the transport unit; a dispensing box attachment unit to which coins recognized by the dispensing recognition unit are sent by the transport unit; a dispensing box which has a box body, which opens vertically, and a bottom plate for opening/closing a bottom of the box body, can be attached to and detached from the dispensing box attachment unit and receives coins, which are sent to the dispensing box attachment unit, from an upper face of the box body; a locking mechanism for locking the dispensing box attached to the dispensing box attachment unit; an opening/closing mechanism for opening/closing the bottom plate of the dispensing box attached to the dispensing box attachment unit; a collection unit for collecting coins which are dropped by opening of the bottom plate of the dispensing box; a control unit for allowing coins to be fed from the coin storing and feeding unit in a state where the dispensing box attached to the dispensing box attachment unit is locked by the locking mechanism, allowing the fed coins to be transported by the transport unit, recognized by the dispensing recognition unit and sent to the dispensing box, allowing locking by the locking mechanism to be cancelled when the coins for dispensing sent to the dispensing box are recognized as normal coins by the dispensing recognition unit, and allowing the bottom plate of the dispensing box to be opened by the opening/closing mechanism when, among the sent coins, an abnormal coin is recognized by the dispensing recognition unit. As described above, coins are fed from the coin storing and feeding unit in a state where the dispensing box attached to the dispensing box attachment unit is locked, the fed coins are transported by the transport unit, recognized by the dispensing recognition unit and sent to the dispensing box; when the coins for dispensing sent to the dispensing box are recognized as normal coins, the dispensing box is unlocked, the dispensing box is detached from the dispensing box attachment unit and the coins can be taken out; and when an abnormal coin is recognized, the bottom plate of the dispensing box is opened by the opening/closing mechanism with the dispensing box locked, and coins dropping from the dispensing box can be collected in the collection unit. Thus, the dispensing box can have a function of escrowing coins. Therefore, no dispensing escrow unit is required, and downsizing and cost reduction can be realized. Additionally, coins are not required to be transported from the dispensing escrow unit to the dispensing box, thereby shortening the processing time for dispensing coins. Further, an abnormal coin can be collected in the collection unit even if being mixed in normal coins in the dispensing box, and therefore the dispensing box containing an abnormal coin can be prevented from being taken out.

The dispensing box, the bottom plate of which is opened, forms a part of a collection route for collecting coins from the coin storing and feeding unit into the collection unit. Since the dispensing box, the bottom plate of which is opened, thus forms a part of a collection route for collecting coins from the coin storing and feeding unit into the collection unit, the collection route can be used in common with a dispensing route and simplified in constitution.

When coins in the coin storing and feeding unit are collected in the collection unit, the control unit allows the bottom plate of the dispensing box to be opened by the opening/closing mechanism in a state where the dispensing box attached to the dispensing box attachment unit is locked by the locking mechanism, allows coins to be fed from the coin storing and feeding unit, and allows the fed coins to be transported by the transport unit and sent to the dispensing box. Since, as described above, when coins in the coin storing and feeding unit are collected in the collection unit, the bottom plate of the dispensing box is opened in a state where the dispensing box attached to the dispensing box attachment unit is locked, coins are fed from the coin storing and feeding unit, and the fed coins are transported by the transport unit and sent to the dispensing box, coins passing through the dispensing box can be collected in the collection unit and the processing time for collecting coins can be shortened.

The dispensing box has a latching mechanism for latching the bottom plate in a closing position of closing the bottom of the box body in conjunction with cancelling locking of the dispensing box by the locking mechanism, or unlatching the bottom plate in conjunction with locking of the dispensing box by the locking mechanism. Since the latching mechanism of the dispensing box thus can latch the bottom plate in the closing position of closing the bottom of the box body in conjunction with cancelling locking of the dispensing box by the locking mechanism or unlatch the bottom plate in conjunction with locking of the dispensing box by the locking mechanism, the bottom plate of the dispensing box detached from the machine body can be prevented from being opened, the locking mechanism can be used for both locking of the dispensing box and unlocking of the bottom plate, and the mechanism can be simplified in constitution.

A dispensing box with chute for outside collection for sending coins, which are sent to the dispensing box attachment unit, outside the machine body can be attached to the dispensing attachment unit from which the dispensing box is detached. Coins sent to the dispensing box attachment unit can be sent outside the machine body by thus attaching the dispensing box with chute for outside collection to the dispensing box attachment unit from which the dispensing box is detached.

DETAILED DESCRIPTION OF THE PREFERRED EMBODIMENT

A first embodiment of the present invention will be described with reference to FIGS. 1 to 5.

Figure 1:
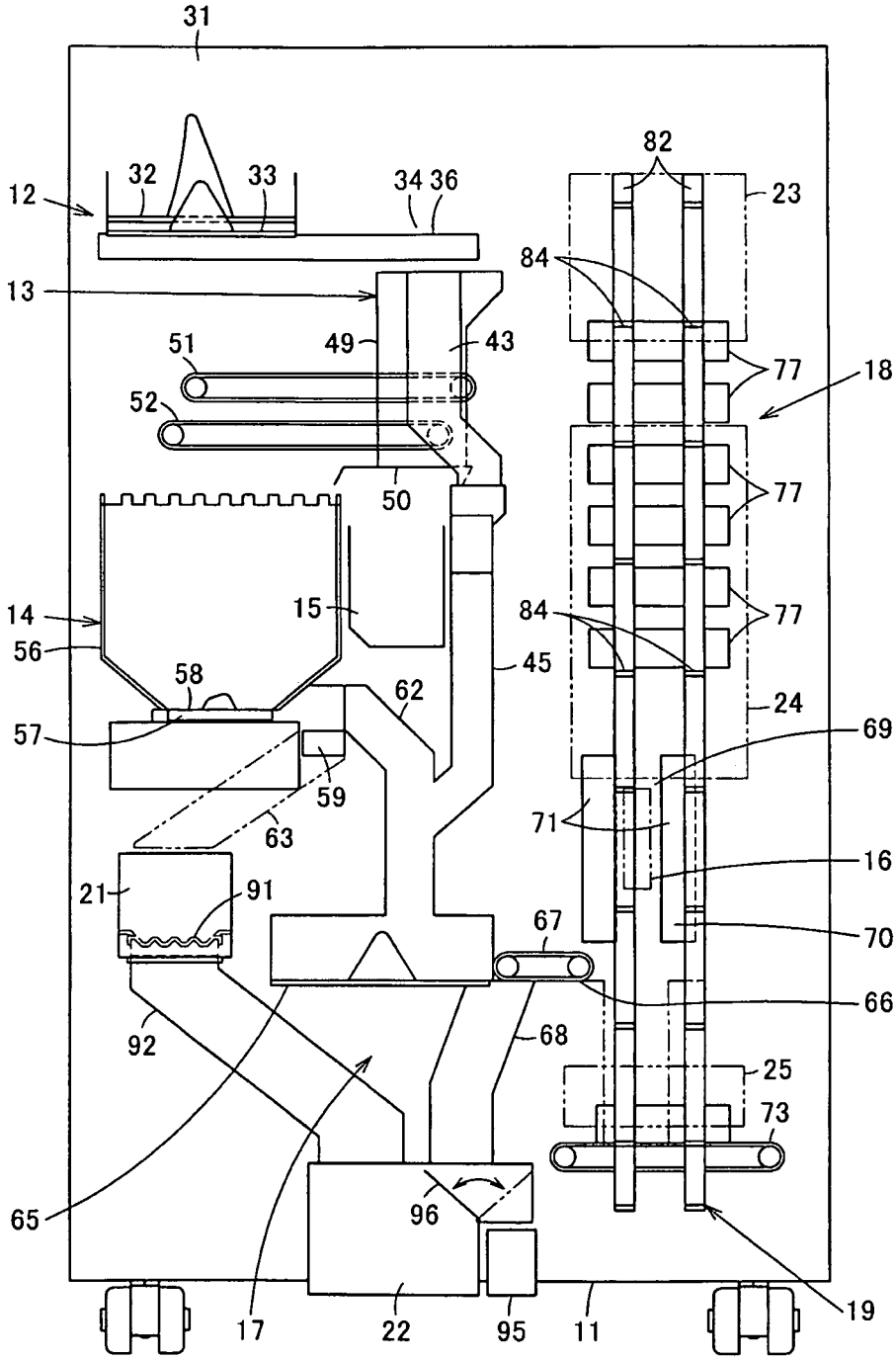
FIG. 1 is a front view showing an inner structure of a coin processing unit of a first embodiment of the present invention.
Figure 2:
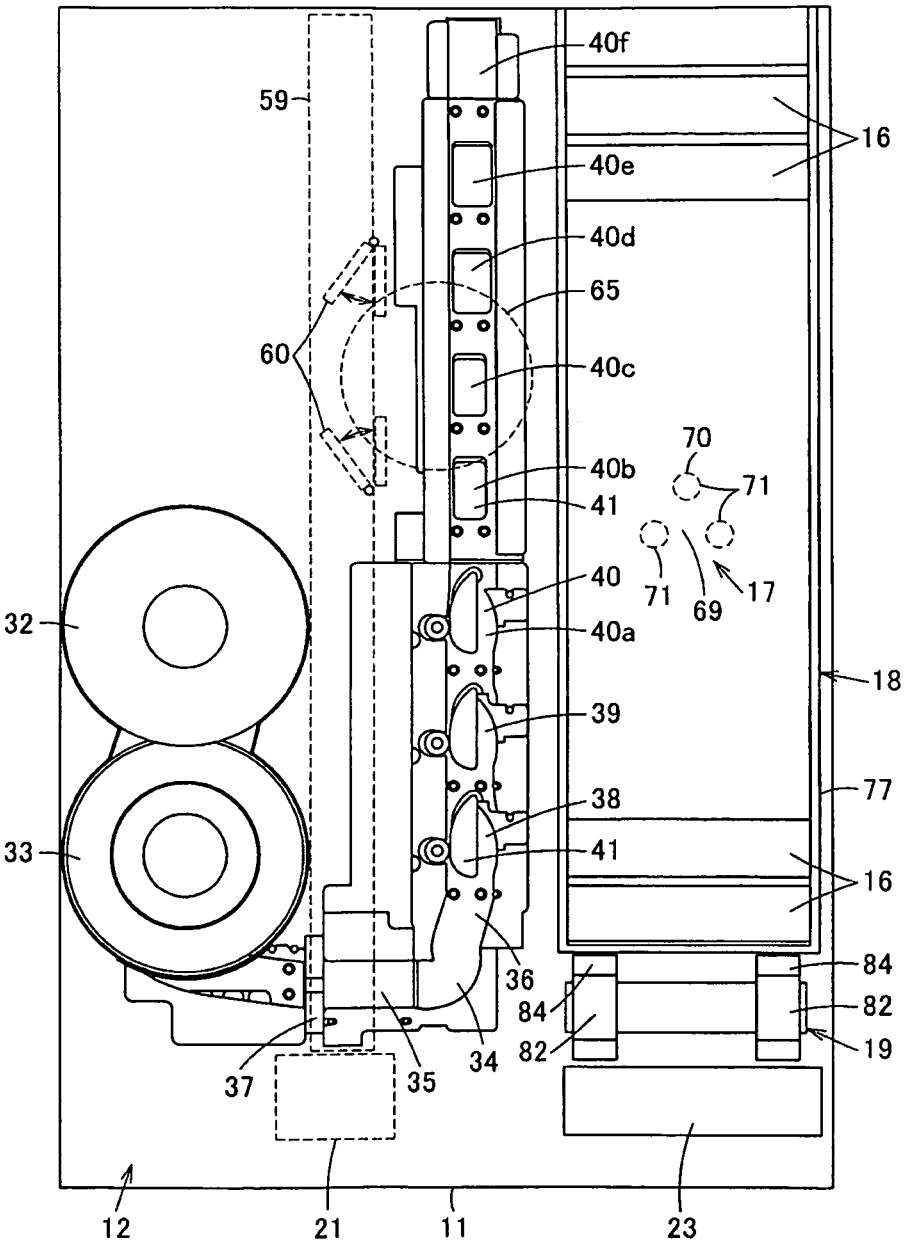
FIG. 2 is a plan view showing the inner structure of the coin processing unit.
Figure 3:
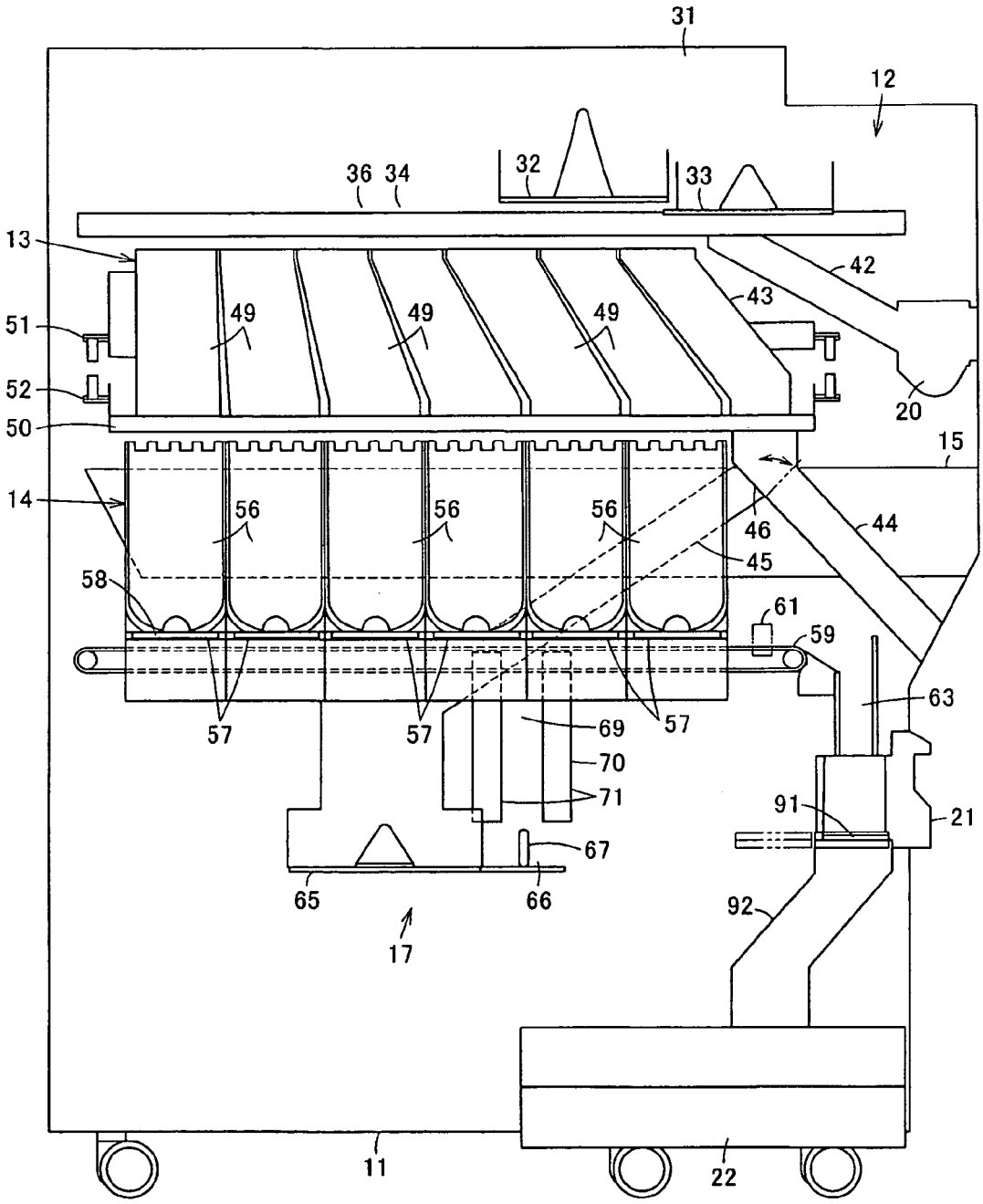
FIG. 3 is a left side view showing the inner structure of the coin processing unit.
Figure 4:
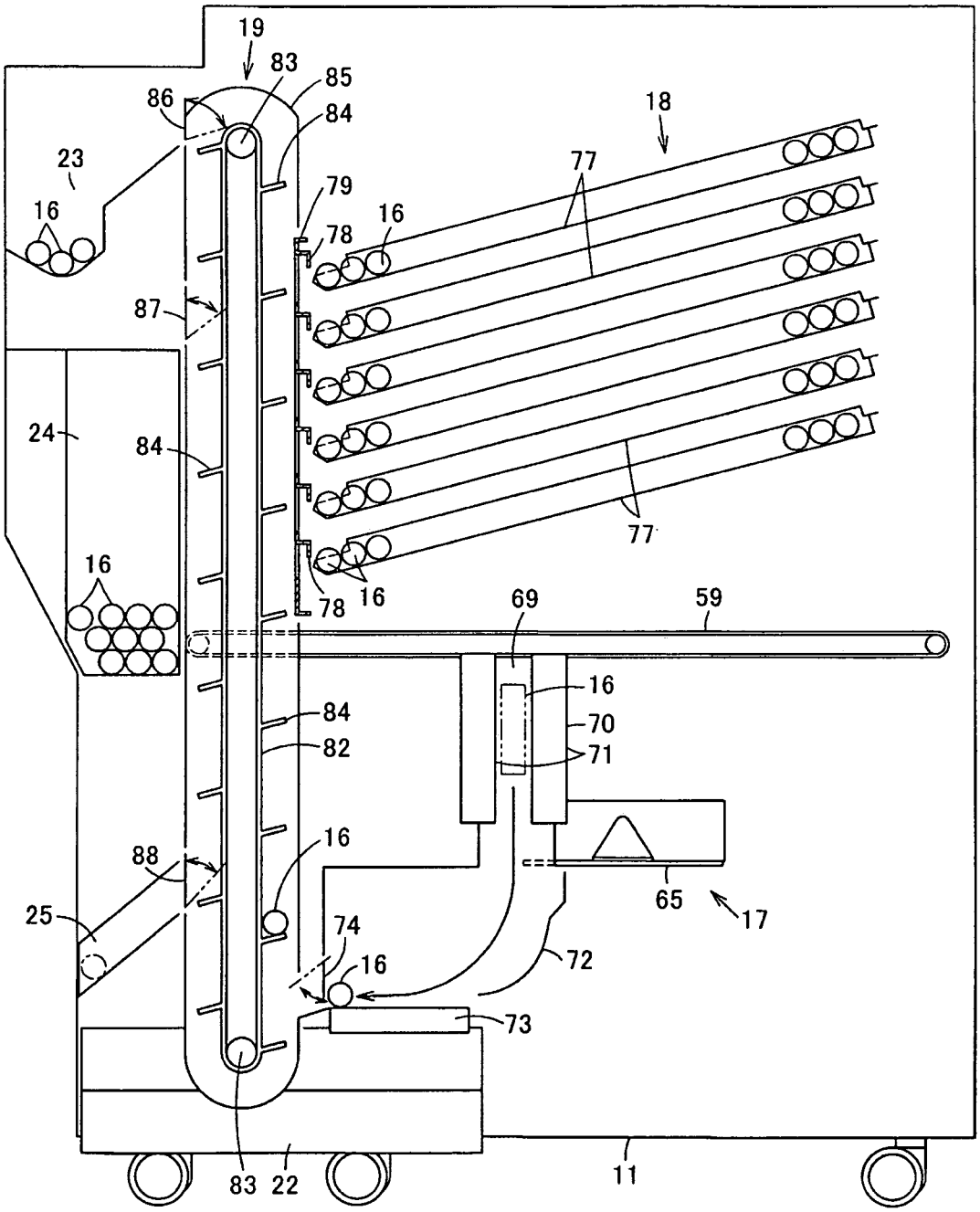
FIG. 4 is a right side view showing the inner structure of the coin processing unit.

FIG. 1 is a front view showing an inner structure of a coin processing unit, FIG. 2 is a plan view showing the inner structure of the coin processing unit, FIG. 3 is a left side view showing the inner structure of the coin processing unit, and FIG. 4 is a right side view showing the inner structure of the coin processing unit.

As shown in FIGS. 1 to 4, the coin processing unit has a machine body 11. When viewed from the front side (FIG. 1), in the machine body 11, a coin receiving and processing unit 12 for receiving, recognizing and sorting coins from the outside of the machine body 11 is arranged in an upper left region, a depositing escrow unit 13 for escrowing coins sorted by denomination by the coin receiving and processing unit 12 is arranged under the coin receiving and processing unit 12, a coin storing and feeding unit 14 for storing and feeding coins sent from the depositing escrow unit 13 and a return box 15 for returning coins sent from the depositing escrow unit 13 are arranged under the depositing escrow unit 13, a wrapping unit 17 for wrapping and forming a predetermined number of stacked coins into a coin-roll 16 as wrapped coins, is arranged under the coin storing and feeding unit 14 and the return box 15, a coin-roll storing and sending unit 18 for storing and sending coin-rolls 16 is arranged on the right side above the wrapping unit 17, and a coin-roll transport unit 19 for transporting coin-rolls 16 is arranged in front of the wrapping unit 17 and the coin-roll storing and sending unit 18. Accordingly, the wrapping unit 17 is arranged in a lower region in the machine body 11, the coin storing and feeding unit 14 and the coin-roll storing and sending unit 18 are arranged side by side in a lateral direction, width direction, of the machine body 11 above the wrapping unit 17, and the depositing escrow unit 13 and the coin receiving and processing unit 12 located therearbove are arranged above the coin storing and feeding unit 14.

At the front side of the machine body 11, a return port 20 for returning rejected coins is arranged in front of the depositing escrow unit 13, a dispensing box 21 is attachably/detachably arranged in front of the wrapping unit 17, a collection unit 22 for collecting coins is attachably/detachably arranged under the wrapping unit 17, a coin-roll outlet 23 for dispensing coin-rolls 16 and a collective coin-roll storing unit 24 for collectively storing coin-rolls 16 are attachably/detachably arranged in front of the coin-roll storing and sending unit 18, and a coin-roll dispensing port 25 for dispensing coin-rolls 16 outside the coin processing unit is arranged in front of the wrapping unit 17.

The coin receiving and processing unit 12 includes: a supplying disk 32 for receiving loose coins which are put in an inlet 31 formed in an upper face of the machine body 11; a centrifugal disk 33 to which a suitable number of coins are supplied from the supplying disk 32; and a coin passage 34 for transporting coins fed one by one from the centrifugal disk 33.

The coin passage 34 has a recognition passage portion 35 extending from the centrifugal disk 33 in the width direction of the machine body 11 and a sorting passage portion 36 extending from the recognition passage portion 35 along a depth direction of the machine body 11, and a transport belt (not shown) for transporting coins is arranged on the passage.

A depositing recognition unit 37 for recognizing a denomination, authenticity, fitness, etc., of a transported coin is arranged on the recognition passage portion 35.

On the sorting passage portion 36, a rejected coin diverter 38, an arbitrary coin diverter 39 and a denomination-specific coin diverter 40 are arranged in this order from the upstream side to the downstream side.

The denomination-specific coin diverter 40 has a 5-yen coin diverter 40*a*, a 1-yen coin diverter 40*b*, a 50-yen coin diverter 40*c*, a 100-yen coin diverter 40*d*, a 10-yen coin diverter 40*e* and a 500-yen coin diverter 40*f*. A diversion hole 41 for dropping and diverting corresponding coins is formed in each of the diverters 38 to 40. The rejected coin diverter 38, arbitrary coin diverter 39 and 5-yen coin diverter 40*a* can forcibly drop coins into the diversion holes 41 by electric driving mechanisms such as a solenoid, respectively. The denomination-specific diverters 40*b* to 40*f* can sort coins in the order of enlarging in diameter to drop them to the corresponding diversion holes 41, respectively.

A return chute 42 for guiding rejected coins to the return port 20 is arranged on a lower part of the rejected coin diverter 38.

A chute 43 is arranged on a lower part of the arbitrary coin diverter 39, a chute for bag capture 44 and a chute for direct wrapping 45 are arranged on a lower part of the chute 43, and a switching plate 46 is arranged for selectively guiding coins from the chute 43 to either the chute for bag capture 44 or the chute for direct wrapping 45. The chute for bag capture 44 guides coins into a bag attached to a bag attachment unit (not shown) arranged on a front face of the machine body 11 so that the coins are stored in the bag.

Additionally, the depositing escrow unit 13 is arranged along the depth direction of the machine body 11 side by side by denomination, and can receive and escrow coins, which are diverted by denomination by the denomination-specific coin diverter 40, by denomination. The depositing escrow unit 13 has denomination-specific escrow pipes 49 and a bottom member 50 for collectively opening/closing bottoms of the escrow pipes 49. Moving mechanisms 51 and 52 respectively allow the escrow pipes 49 and bottom member 50 to independently move in the width direction of the machine body 11.

As shown in FIG. 1, the escrow pipes 49 are located under the denomination-specific coin diverter 40 on the sorting passage portion 36 and can escrow coins with the bottoms of the escrow pipes 49 closed by the bottom member 50. When escrowed coins are stored, only the escrow pipes 49 move leftward to a region located above the coin storing and feeding unit 14, the bottoms of the escrow pipes 49 are opened, and coins in the escrow pipes 49 are ejected to the coin storing and feeding unit 14. On the other hand, when escrowed coins are returned, only the bottom member 50 moves leftward from a region located above the return box 15, the bottoms of the escrow pipes 49 are opened, and coins in the escrow pipes 49 are ejected to the return box 15.

Additionally, the coin storing and feeding unit 14 is arranged along the depth direction of the machine body 11 side by side by denomination, and has denomination-specific coin storing units 56 for receiving and storing coins dispensed from the depositing escrow unit 13 and coin feeding units 57 each for feeding coins one by one from a lower part of the coin storing unit 56.

In the coin feeding unit 57, for example, a centrifugal disk for feeding 58 having a plurality of feeding holes, into which coins are inserted one by one, is used, and coins inserted in the feeding holes are fed one by one sideward from a peripheral portion of the centrifugal disk for feeding 58 by rotation of the centrifugal disk for feeding 58.

A conveyor 59 for receiving coins fed from a lower part of the coin storing and feeding unit 14 is arranged, aside of the coin storing and feeding unit 14, along the depth direction of the machine body 11. Ejecting mechanisms 60 for ejecting coins on the conveyor 59 are arranged at a center region of the conveyor 59, and a reverse rotation roller (not shown) for aligning coins in one layer and one line and a dispensing recognition unit 61 for recognizing coins aligned in one layer and one line are arranged at a front end side of the conveyor 59. At the time of wrapping coins, coins fed from the center region to a front region on the conveyor 59 are transported to the center region of the conveyor 59 and ejected from an upper face of the conveyor 59 by the ejecting mechanisms 60, or coins fed from the center region to a rear region on the conveyor 59 are transported to the center region of the conveyor 59 and ejected from the upper face of the conveyor 59 by the ejecting mechanisms 60, and the coins ejected from the upper face of the conveyor 59 are sent to the wrapping unit 17 through a chute 62.

At the time of dispensing or collecting coins, coins received on the conveyor 59 are transported forward, and sent to the dispensing box 21 through a chute 63 after recognition by the dispensing recognition unit 61.

The return box 15 is long in the depth direction of the machine body 11, and arranged attachable and detachable from the front face of the machine body 11.

In the wrapping unit 17, there are disposed: a centrifugal disk for wrapping 65 for receiving coins fed from the coin storing and feeding unit 14 and guided by the chute 62 or coins for direct wrapping diverted by the arbitrary coin diverter 39 and guided by the chute for direct wrapping 45; and a coin passage for wrapping 66 for receiving and transporting coins fed one by one by rotation of the centrifugal disk for wrapping 65. A transport belt 67 for transporting coins is arranged on the coin passage for wrapping 66. The width of the coin passage for wrapping 66 is adjusted and set, based on denomination setting, in accordance with denominations of coins to be wrapped. A coin having a diameter larger than that of a coin to be wrapped is prevented from entering the coin passage for wrapping 66, and a coin having a diameter smaller than that of a coin to be wrapped is eliminated from an elimination port (not shown) provided in a passage face of the coin passage for wrapping 66. Coins eliminated from the elimination port are collected in the collection unit 22 through a chute 68.

A sensor, stopper, etc., are disposed on the coin passage for wrapping 66, the sensor detecting the number of transported coins and passage of coins, and the stopper stopping, based on detection by the sensor, a coin following a coin of a predetermined stacked number transported to a downstream region from the coin passage for wrapping 66.

A stacking unit 69 for successively stacking coins, which are sent from the coin passage for wrapping 66, upward from the lower side so as to stack a predetermined number of coins is disposed on a downstream region of the coin passage for wrapping 66. The stacking unit 69 is formed between three wrapping rollers 71 of a wrapping mechanism 70 and approximately perpendicular to a stacking bottom plate (not shown) arranged flush with the passage face of the coin passage for wrapping 66. A stacking roller (not shown) projecting upward from the stacking bottom plate is disposed on a lower part of the stacking unit 69. By rotation of the stacking roller, coins sent from the coin passage for wrapping 66 are taken into the lower portion of the stacking unit 69, a rear end of the coin in a sending direction is raised higher than the passage face of the coin passage for wrapping 66 and an upper face of the stacking bottom plate, a leading end of a successively sent coin in the sending direction is taken in under the coin located on the lower part of the stacking unit 69, and coins are stacked.

In the wrapping mechanism 70, a predetermined number of stacked coins are pushed up to a predetermined wrapping position by a support rod (not shown) projecting upward from a passage bottom plate, circumferences of the stacked coins are clamped and rotated by the three wrapping rollers 71, a wrapping sheet (not shown) is wound around the circumferences of the stacked coins, the ends of the wrapping sheet are caulked to the end faces of the stacked coins, and thus the coin-roll 16 is formed.

Accordingly, in the wrapping unit 17, a stacking position of stacking coins corresponds to the wrapping position of wrapping the stacked coins.

The passage bottom plate, stacking roller, support rod, etc., retreat from a position under the stacking unit 69 and can eject formed coin-rolls 16 downward.

A coin-roll chute 72 is disposed under the stacking unit 69, the chute 72 receiving coin-rolls 16, which are ejected from the wrapping unit 17 with a longitudinal direction (stacking direction) of the roll 16 corresponding to a vertical direction, and guiding the rolls 16 so that the rolls roll forward, while making the longitudinal direction parallel with the front face of the machine body 11 and horizontal. A laterally transporting unit 73 and a switching member 74 for switching ejecting and non-ejecting of coin-rolls 16 from the laterally transporting unit 73 forward to the coin-roll transport unit 19 are arranged at a leading end side of the coin-roll chute 72.

When another coin-roll storing unit is provided aside of the machine body 11, the laterally transporting unit 73 is used for transporting coin-rolls 16 to and from the coin-roll storing unit.

Additionally, a plurality of denomination-specific coin-roll trays 77 for storing a plurality of coin-rolls 16 are vertically arranged in multiple stages, with the trays tilted forward and downward, in the coin-roll storing and sending unit 18. The coin-roll tray 77 is long in the depth direction of the machine body 11. The coin-roll tray 77 aligns and stores a plurality of coin-rolls 16 in the depth direction of the machine body, and pulls aside the stored coin-rolls 16 forward by tilt of the coin-roll tray 77 to store them in an aligned state, with the longitudinal direction of the coin-roll 16 parallel with the front face of the machine body 11 and horizontal. Each coin-roll tray 77 can move, in the direction of tilt, between an advancing position, where a front end of the coin-roll tray 77 advances to the coin-roll transport unit 19, and a retreating position, where the front end retreats backward from the advancing position, by a coin-roll tray driving mechanism (not shown).

A stopper 79 having a plurality of stopper portions 78 corresponding to the coin-roll trays 77 is vertically movably arranged in front of the plurality of coin-roll trays 77 and between the trays 77 and the coin-roll transport unit 19. In the stopper 79, the stopper portion 78 comes into contact with a foremost coin-roll 16 in the advancing coin-roll tray 77 at a descending position, and does not come into contact with the coin-roll 16 in the advancing coin-roll tray 77 at an ascending position.

The coin-roll transport unit 19 has a coin-roll transport belt 82 for transporting coin-rolls 16 with the longitudinal direction parallel with the front face of the machine body 11 and horizontal, and the coin-roll transport belt 82 is vertically turnably stretched between upper and lower rollers 83. A plurality of coin-roll support portions 84 for supporting and transporting coin-rolls 16 are projected on a peripheral face of the coin-roll transport belt 82. Additionally, a guide body 85 for guiding coin-rolls 16 between the body 85 and the coin-roll transport belt 82 is arranged on the periphery of the coin-roll transport belt 82.

Hereinafter, storage of coin-rolls 16 into the coin-roll tray 77 and sending of coin-rolls 16 from the coin-roll tray 77 by the coin-roll tray 77, stopper 79 and coin-roll transport unit 19 will be described.

At the time of storing coin-rolls 16 in the coin-roll tray 77, a coin-roll 16, which is wrapped in the wrapping unit 17 and is ejected forward, is supported and transported upward by the coin-roll support portion 84 of the coin-roll transport belt 82, and made to temporarily upwardly pass the coin-roll tray 77 for storing the coin-roll 16, the coin-roll tray 77 for storing the coin-roll 16 is made to advance, a foremost coin-roll 16 in the advancing coin-roll tray 77 is pressed by the stopper portion 78 of the stopper 79 located at the descending position, a space for storing the coin-roll 16 is formed at a foremost portion of the coin-roll tray 77, the coin-roll 16 is then made to descend by the coin-roll transport belt 82 so as to be delivered to the space of the foremost portion of the coin-roll tray 77, and the coin-roll tray 77 is made to retreat.

At the time of sending coin-rolls 16 from the coin-roll tray 77, in a state where the stopper portion 78 of the stopper 79 is made to retreat upward so as not to come into contact with the coin-roll 16 in the coin-roll tray 77, the coin-roll tray 77 is made to advance, the foremost coin-roll 16 in the coin-roll tray 77 is picked up by the coin-roll support portion 84 of the coin-roll transport belt 82, and the coin-roll tray 77 is made to retreat.

The coin-roll outlet 23, collective coin-roll storing unit 24 and coin-roll dispensing port 25 are arranged in front of the coin-roll transport belt 82, and switching plates 86, 87 and 88 are arranged in accordance with positions of the coin-roll outlet 23, the collective coin-roll storing unit 24 and the coin-roll dispensing port 25, respectively, the switching plates 86, 87 and 88 selectively sending coin-rolls transported by the coin-roll transport belt 82 to the coin-roll outlet 23, collective coin-roll storing unit 24 and coin-roll dispensing port 25, respectively.

The dispensing box 21 is arranged attachable and detachable from the front face of the machine body 11, and a bottom plate 91 can be opened/closed. A collection chute 92 for guiding coins ejected by opening the bottom plate 91 of the dispensing box 21 to the collection unit 22 is disposed on a lower region of an attachment position of the dispensing box 21.

The collection unit 22 is provided attachable to and detachable from the machine body 11.

A return box 95 is provided aside of the collection unit 22. Coins eliminated through the chute 68 from the wrapping unit 17 at the time of wrapping coins in the coin storing and feeding unit 14 are collected in the collection unit 22 by a switching plate 96, and coins eliminated through the chute 68 from the wrapping unit 17 at the time of direct wrapping are stored in the return box 95 by the switching plate 96. The return box 95 can be attached and detached from the front face of the machine body 11.

Next, operation of the coin processing unit of the first embodiment will be described.

Figure 5:
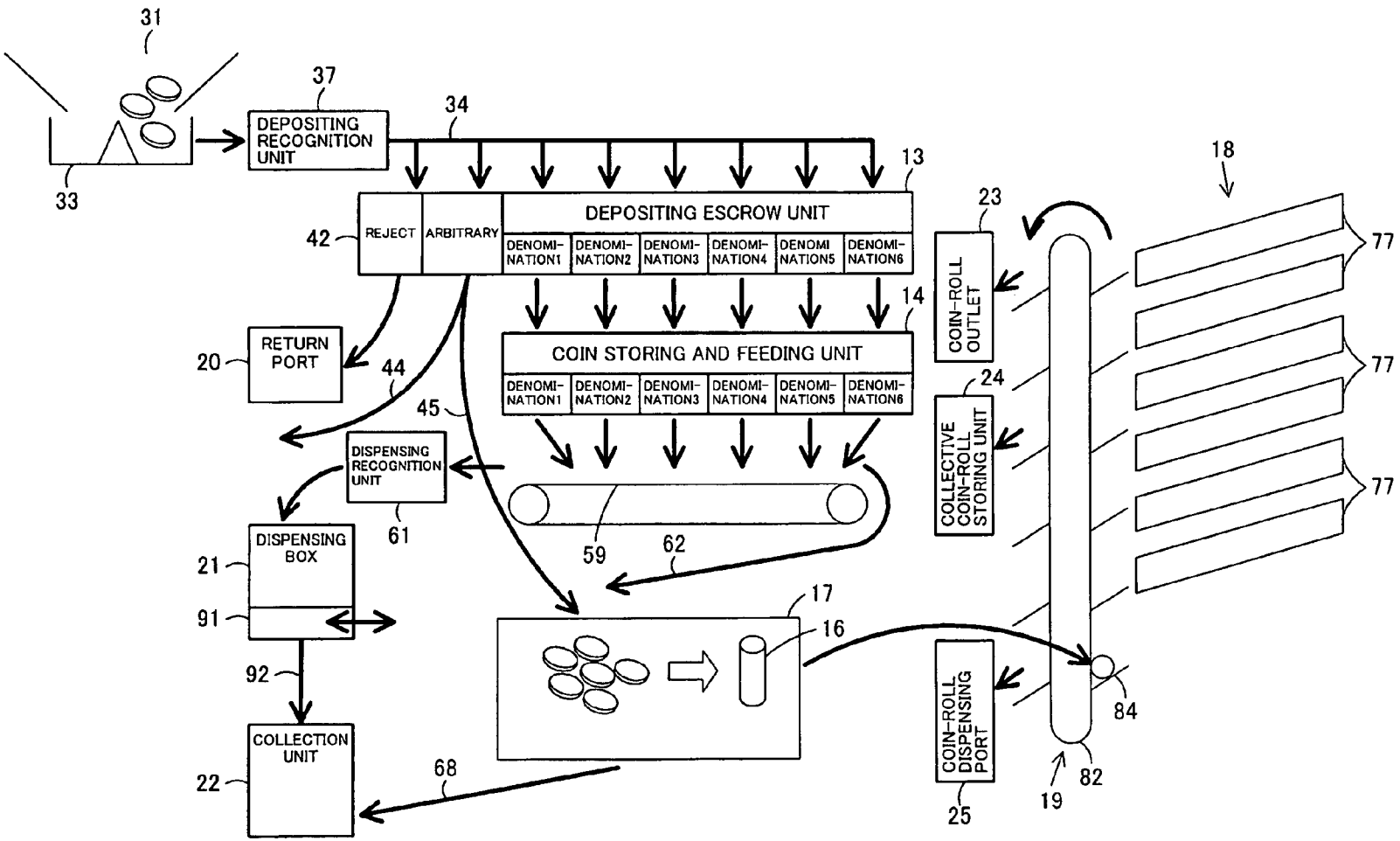
FIG. 5 is an explanatory diagram explaining a flow of coins in the coin processing unit.

FIG. 5 is an explanatory diagram explaining a flow of coins in the coin processing unit.

At the time of a depositing process of coins, coins put in the inlet 31 are fed one by one from the centrifugal disk 33 to the coin passage 34, and the coins transported through the coin passage 34 are recognized by the depositing recognition unit 37.

As a result of recognition, rejected coins are diverted by the rejected coin diverter 38 and sent to the return port 20 through the return chute 42. Normal coins are diverted by denomination by the denomination-specific coin diverter 40, and escrowed in the depositing escrow unit 13 by denomination.

By a storing instruction after escrow, coins escrowed in the depositing escrow unit 13 are stored in the coin storing and feeding unit 14 by denomination.

By a returning instruction after escrow, coins escrowed in the depositing escrow unit 13 are sent to the return box 15, and the returned coins in the return box 15 can be taken out by detaching the return box 15 from the machine body 11.

At the time of a dispensing process of coins, coins are fed from the coin storing and feeding unit 14 onto the conveyor 59, transported by the conveyor 59, recognized by the dispensing recognition unit 61 and sent to the dispensing box 21. At that time, the bottom plate 91 of the dispensing box 21 is closed, and the sent coins are pooled in the dispensing box 21.

If all coins for dispensing sent to the dispensing box 21 are recognized as normal coins by the depositing recognition unit 61, the dispensing box 21 is unlocked, and the coins for dispensing in the dispensing box 21 can be taken out by detaching the dispensing box 21 from the machine body 11.

If an abnormal coin such as a coin of a different denomination is recognized by the dispensing recognition unit 61, the bottom plate 91 of the dispensing box 21 is opened, coins sent to the dispensing box 21 and coins on the conveyor 59 are collected in the collection unit 22. Then, coins for dispensing are re-fed from the coin storing and feeding unit 14 to be re-subjected to the dispensing process.

At the time of counting where put-in coins are counted and taken out without being deposited, coins put in the inlet 31 are fed one by one from the centrifugal disk 33 to the coin passage 34, and the coins transported through the coin passage 34 are recognized by the depositing recognition unit 37, diverted by the arbitrary coin diverter 39 on the coin passage 34, and guided and stored, through the chute for bag capture 44, into a bag attached to the bag attachment unit (not shown) arranged on the front face of the machine body 11.

At the time of a collecting process for collecting coins from the coin storing and feeding unit 14, the bottom plate 91 of the dispensing box 21 is opened, coins are fed from the coin storing and feeding unit 14 onto the conveyor 59 and sent to the collection unit 22 through the conveyor 59, dispensing box 21 and collection chute 92.

At the time of a wrapping process for wrapping coins in the coin storing and feeding unit 14, coins are fed from the coin storing and feeding unit 14 onto the conveyor 59, and the coins on the conveyor 59 are sent to the wrapping unit 17 and formed into a coin-roll 16 by the wrapping unit 17. The coin-roll 16 formed by the wrapping unit 17 is delivered to the coin-roll transport belt 82 of the coin-roll transport unit 19, transported upward by the coin-roll transport belt 82, and stored in the coin-roll tray 77 of the corresponding denomination of the coin-roll storing and sending unit 18.

At the time of dispensing or collecting coin-rolls 16 stored in the coin-roll storing and sending unit 18, a necessary number of coin-rolls 16 are taken out from the target coin-roll tray 77 by the coin-roll transport belt 82, and sent to the coin-roll outlet 23 or collective coin-roll storing unit 24.

At the time of direct wrapping for wrapping and taking out put-in coins without depositing, coins put in the inlet 31 are fed one by one from the centrifugal disk 33 to the coin passage 34, and the coins transported through the coin passage 34 are recognized by the depositing recognition unit 37, diverted by the arbitrary coin diverter 39 on the coin passage 34, sent to the wrapping unit 17 through the chute for direct wrapping 45, and formed into a coin-roll 16 by the wrapping unit 17. The coin-roll 16 formed by the wrapping unit 17 is delivered to the coin-roll transport belt 82 of the coin-roll transport unit 19, transported by the coin-roll transport belt 82, and dispensed outside the coin processing unit through the coin-roll dispensing port 25.

In the coin processing unit thus constituted, since the wrapping unit 17 is arranged in the lower region in the machine body 11, and the coin storing and feeding unit 14 and the coin-roll storing and sending unit 18 are arranged above the wrapping unit 17, the machine body 11 can be downsized in its width direction. Further, no route is required for transporting coins in the coin storing and feeding unit 14 upward and sending them to the wrapping unit 17, contributing to downsizing of the machine body 11 in its width direction.

Since the coin storing and feeding unit 14 is arranged along the depth direction of the machine body 11 side by side by denomination and the coin-roll storing and sending unit 18 aligns and stores a plurality of coin-rolls 16 along the depth direction of the machine body 11, the machine body 11 can be downsized in its width direction even if the coin storing and feeding unit 14 and the coin-roll storing and sending unit 18 are arranged side by side in the width direction of the machine body 11.

In the coin storing and feeding unit 14, coins are fed from the lower parts of the coin storing units 56 storing the coins and sent to the wrapping unit 17 located under the coin storing units 56, and thus can be processed in the direction of gravity, and the processing speed can be improved.

Coin-rolls 16 formed by the wrapping unit 17 can be transported to the coin-roll storing and sending unit 18 by the coin-roll transport unit 19 arranged in front of the wrapping unit 17 and the coin-roll storing and sending unit 18, and thus can be promptly stored in the coin-roll storing and sending unit 18 compared with the case of laterally transporting and storing the coin-rolls 16, and the processing speed can be improved.

Since the coin receiving and processing unit 12 is arranged in the upper region in the machine body 11 and the depositing escrow unit 13 is arranged under the coin receiving and processing unit 12 and above the coin storing and feeding unit 14, the coin receiving and processing unit 12, depositing escrow unit 13, coin storing and feeding unit 14 and wrapping unit 17 are vertically aligned and the machine body 11 can be downsized in its width direction.

Since coins are successively stacked upward in the stacking unit 69 of the wrapping unit 17 and a predetermined number of stacked coins are wrapped, a space vertically required can be made small and the coin processing unit can be downsized compared with the case of successively stacking coins downward, moving a predetermined number of stacked coins further downward and wrapping them.

Since the centrifugal disk for wrapping 65 of the wrapping unit 17 is arranged under the coin storing and feeding unit 14 and the stacking unit 69 and the wrapping mechanism 70 are arranged under the coin-roll storing and sending portion 18, a route for sending coins in the coin storing and feeding unit 14 to the centrifugal disk for wrapping 65 and a route for storing coin-rolls 16 formed by the stacking unit 69 and the wrapping mechanism 70 into the coin-roll storing and sending unit 18 can be simplified in constitution, and the coin processing unit can be downsized.

Next, a second embodiment of the present invention will be described with reference to FIGS. 6 to 11.

Figure 6:
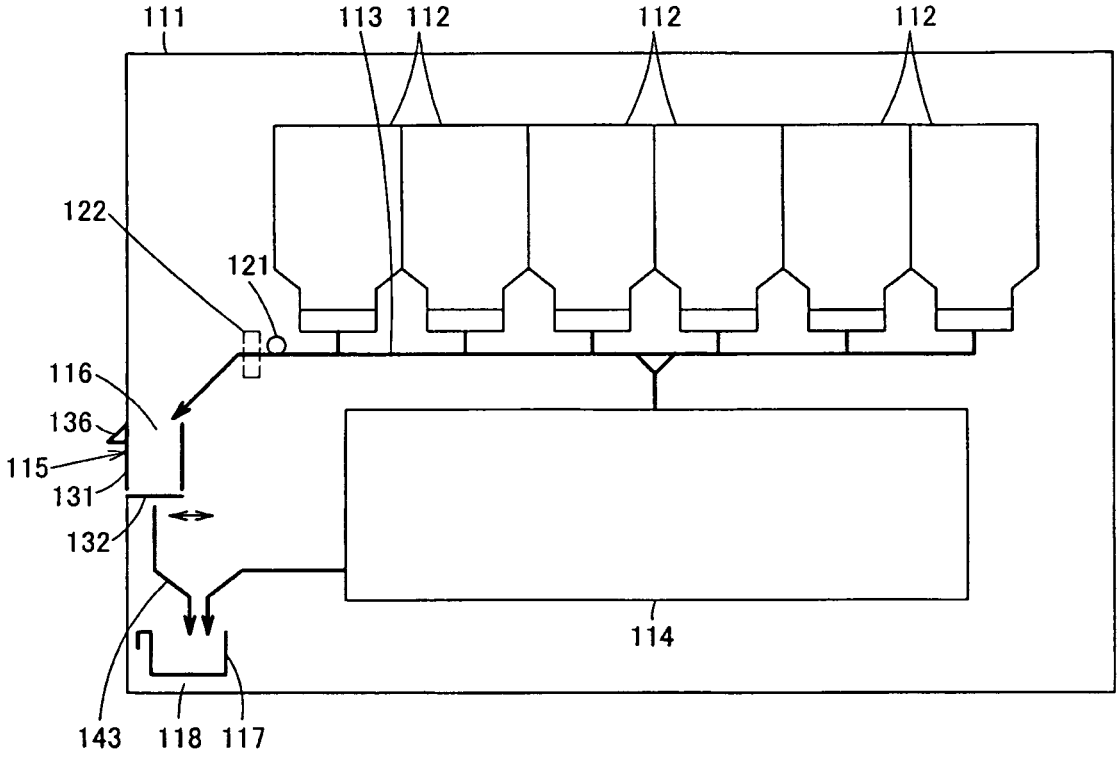
FIG. 6 is a right side view showing a schematic structure of a coin processing unit of a second embodiment of the present invention.

FIG. 6 is a right side view showing a schematic structure of a coin processing unit.

The coin processing unit has a machine body 111. In the machine body 111, denomination-specific coin storing and feeding units 112 each capable of storing loose coins and feeding coins one by one are arranged side by side in a depth direction of the machine body 111, a transport unit 113 for receiving and transporting coins, which are fed from the coin storing and feeding units 112, forward or backward is arranged aside of the coin storing and feeding units 112 along the depth direction of the machine body 111, and a wrapping unit 114 for forming a coin-roll as wrapped coins is arranged under the coin storing and feeding units 112 and the transport unit 113.

A dispensing box attachment unit 116, to and from which a dispensing box 115 for dispensing loose coins can be attached and detached, is formed in the front of the machine body 111, and a collection unit attachment unit 118, to and from which a collection unit 117 can be attached and detached, is formed under the dispensing box attachment unit 116.

Coins put in the machine body are recognized and sorted by denomination by a depositing mechanism (not shown), and stored in the coin storing and feeding units 112.

The transport unit 113 is a belt conveyor, for example. When coins in the coin storing and feeding unit 112 are wrapped, the transport unit 113 transports coins, which are fed from the coin storing and feeding unit 112 arranged on the front side, backward to send them from a center region of the transport unit 113 to the wrapping unit 114, and transports coins, which are fed from the coin storing and feeding unit 112 arranged on the rear side, forward to send them from the center region of the transport unit 113 to the wrapping unit 114. Additionally, when coins in the coin storing and feeding units 112 are dispensed or collected, coins fed from the coin storing and feeding units 112 are transported forward and sent to the dispensing box 115.

At a front end of the transport unit 113, there are arranged: a reverse rotation roller 121 as a regulating unit for regulating coins to be sent to the dispensing box 115 in one layer and one line; and a dispensing recognition unit 122 for recognizing denominations and the number of coins regulated and transported in one layer and one line.

The wrapping unit 114 feeds coins sent from the transport unit 113 to a coin passage for wrapping one by one, stacks a predetermined number of coins, wraps the stacked coins by winding a wrapping sheet around a circumference of the coins and forms a coin-roll. Formed coin-rolls are sent to a coin-roll outlet (not shown) provided on the machine body 111 or stored in a coin-roll storing unit (not shown) arranged in the machine body 111. An abnormal coin such as a coin of a denomination different from the denomination of wrapped coins is eliminated from the coin passage for wrapping, and sent to the collection unit 117.

Figure 7:
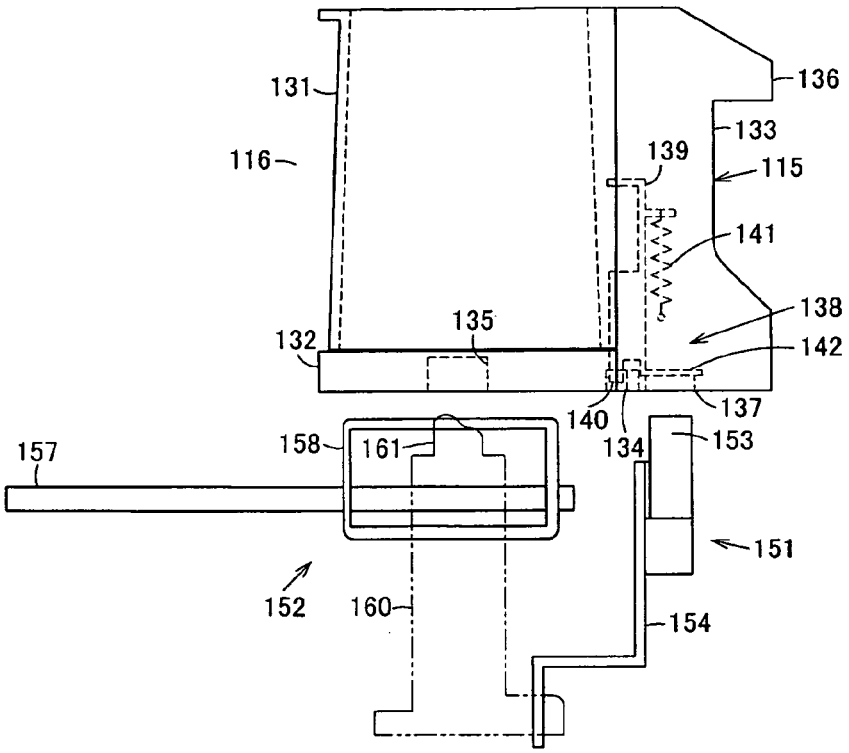
FIG. 7 is a left side view of the coin processing unit in which a dispensing box is unlocked.
Figure 8:
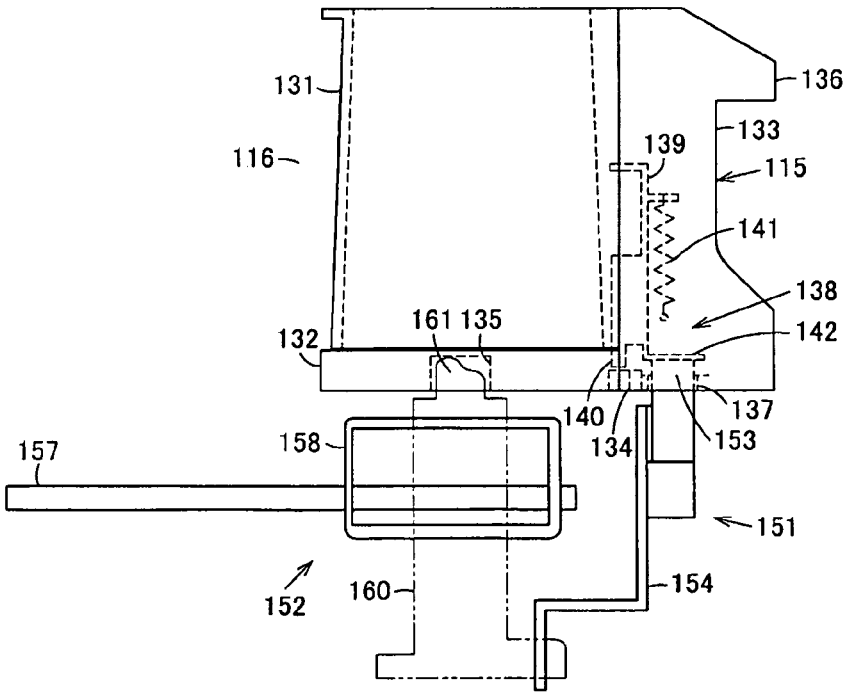
FIG. 8 is a left side view of the coin processing unit in which the dispensing box is locked and a bottom plate is closed.
Figure 9:
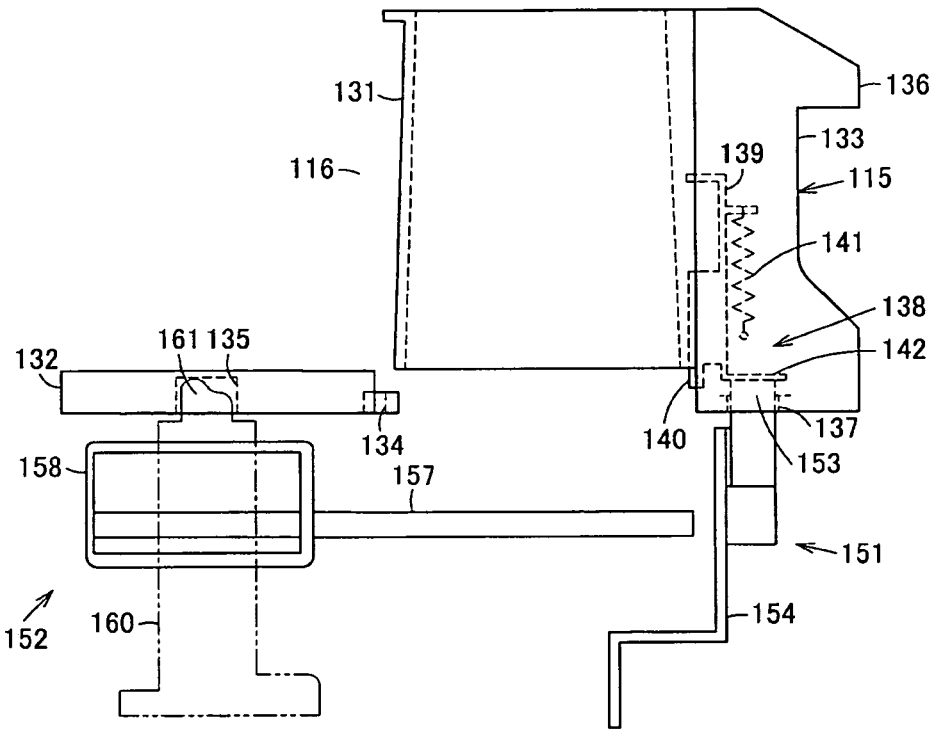
FIG. 9 is a left side view of the coin processing unit in which the dispensing box is locked and the bottom plate is opened.

FIG. 7 is a left side view of the coin processing unit in which the dispensing box is unlocked. FIG. 8 is a left side view of the coin processing unit in which the dispensing box is locked and a bottom plate is closed. FIG. 9 is a left side view of the coin processing unit in which the dispensing box is locked and the bottom plate is opened.

The dispensing box 115 has a quadrilateral pipe-shaped box body 131 vertically opened. A bottom plate 132 is openably/closably arranged at a bottom of the box body 131, a cover 133, which constitutes a part of the box body 131, is attached to a front face of the box body 131.

An inner face of the box body 131 is formed in a tilted shape of expanding downward so that a lower face opening of the box body 131 becomes wider than an upper face opening thereof.

The bottom plate 132 is slidably supported on the box body 131 between a closing position of closing the bottom of the box body 131 and an opening position of sliding to a rear side of the box body 131 and opening the bottom of the box body 131. A latch hole 134 opening upward is formed in a front end of the bottom plate 132, and a connection hole 135 opening downward is formed in the middle of the bottom plate 132.

A knob portion 136 for attaching and detaching the dispensing box 115 to and from the dispensing box attachment unit 116 is formed at a front part of the cover 133. A lock hole 137 is formed in a bottom of the cover 133.

A latching mechanism 138 for latching the bottom plate 132 to the closing position is arranged between the box body 131 and the cover 133. The latching mechanism 138 has a latch body 139 which is vertically slidably attached to the box body 131 or cover 133, and a latch portion 140, which is inserted in the latch hole 134 of the bottom plate 132 from above to lock the bottom plate 132 in the closing position, is projected on a lower part of the latch body 139. The latch body 139 is biased downward, in a direction that the latch portion 140 is inserted in the latch hole 134 of the bottom plate 132 by a coil spring 141 as a biasing mechanism stretched between the latch body 139 and the box body 131 or cover 133. An abutting portion 142, which is arranged opposite the lock hole 137 of the cover 133, is formed by bending the lower part of the latch body 139.

Coins sent to the dispensing box 115 pass downward to be sent to the collection unit 117 with the bottom plate 132 of the dispensing box 115, which is attached to the dispensing box attachment unit 116, opened. That is, an inner space of the box body 131 of the dispensing box 115, for which the bottom plate 132 is opened, forms a part of a collection route 143 for collecting coins from the coin storing and feeding units 112 into the collection unit 117.

A locking mechanism 151 for locking the dispensing box 115 attached to the dispensing box attachment unit 116 and an opening/closing mechanism 152 for opening/closing the bottom plate 132 of the dispensing box 115 locked by the locking mechanism 151 are arranged in the dispensing box attachment unit 116.

The locking mechanism 151 has a lock member 154, on which a lock portion 153 capable of being inserted in the lock hole 137 of the dispensing box 115 is projected, and a lock driving unit 155 (see FIG. 10) such as a motor or solenoid (not shown) for moving the lock member 154 vertically. The lock member 154 moves, by driving of the lock driving unit 155, between an unlocking position where the lock portion 153 moves away from the dispensing box 115 downward and the dispensing box 115 can be attached to and detached from the dispensing box attachment unit 116, and a locking position where the lock portion 153 is inserted in the lock hole 137 of the dispensing box 115 and the dispensing box 115 is locked to the dispensing box attachment unit 116. The unlocking position and locking position of the lock member 154 are detected by a lock detection unit 156 (see FIG. 10) using a switch, sensor, etc. (not shown).

When the lock member 154 ascends from the unlocking position to the locking position, the lock portion 153 abuts the abutting portion 142 of the latch body 139 in the dispensing box 115, pushes up the latch body 139 against biasing of the coil spring 141 and pulls out the latch portion 140 of the latch body 139 upward from the latch hole 134 of the bottom plate 132, and the bottom plate 132 is unlatched. On the other hand, when the lock member 154 descends from the locking position to the unlocking position, pushing-up of the latch body 139 in the dispensing box 115 by the lock portion 153 is cancelled, the latch body 139 descends by biasing of the coil spring 141, the latch portion 140 of the latch body 139 is inserted in the latch hole 134 of the bottom plate 132 from above, and the bottom plate 132 is latched. Accordingly, the latching mechanism 138 of the dispensing box 115 unlatches the bottom plate 132 in conjunction with locking of the dispensing box 115 by the locking mechanism 151, or latches the bottom plate 132 in the closing position of closing the bottom of the box body 131 in conjunction with cancelling locking of the dispensing box 115 by the locking mechanism 151.

The opening/closing mechanism 152 has: a sliding member 158 supported by a guide 157 so as to slide back and forth; an open/close driving unit 159 (see FIG. 10) such as a motor or solenoid (not shown) for moving the sliding member 158 back and forth; and an opening/closing member 160 which moves back and forth integrally with the sliding member 158 and vertically moves integrally with the lock member 154 in conjunction with its vertical movement. A connecting portion 161 capable of being inserted in the connection hole 135 of the bottom plate 132 of the dispensing box 115 is projected on an upper part of the opening/closing member 160. The opening/closing member 160 moves, by driving of the open/close driving unit 159, between a front closing position of closing the bottom plate 132 of the dispensing box 115 and a rear opening position of opening the bottom plate 132 of the dispensing box 115. The closing position and opening position of the opening/closing member 160 are detected by an open/close detection unit 162 (see FIG. 10) using a switch, sensor, etc. (not shown). Additionally, the opening/closing member 160 moves between a connecting position, where the opening/closing member 160 moves upward integrally with the lock member 154 and the connecting portion 161 is connected to the bottom plate 132, and a disconnecting position, where the member 160 moves downward integrally with the lock member 154 and the bottom plate 132 is disconnected from the connecting portion 161. Besides, in the connecting position, the opening/closing member 160 maintains its connecting position even if moving to the closing position and opening position.

A dispensing box attachment detection unit 166 (see FIG. 10) using a switch, sensor, etc., for detecting attachment of the dispensing box 115 is arranged in the dispensing box attachment unit 116.

Figure 10:
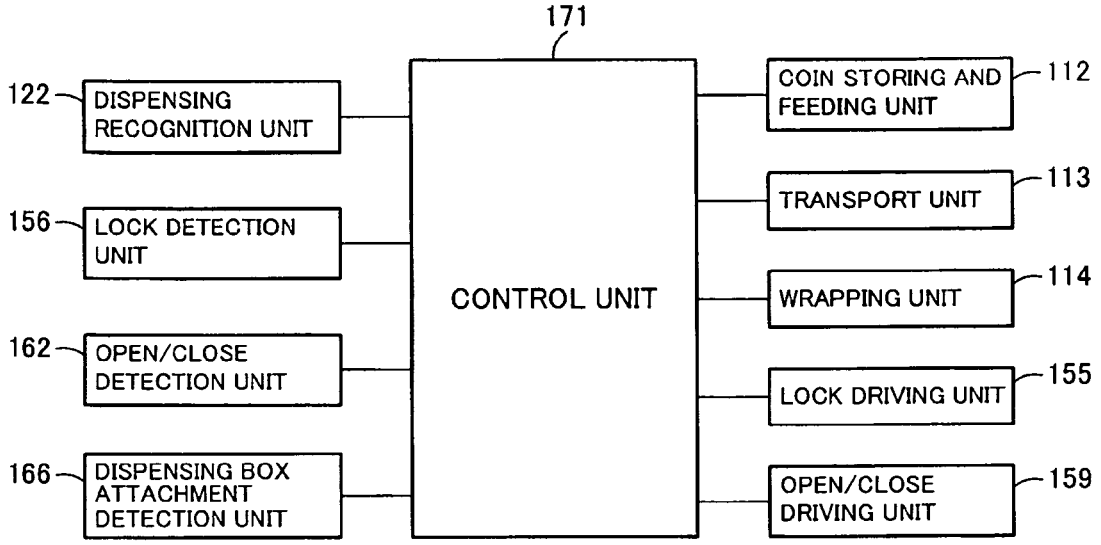
FIG. 10 is a block diagram of the coin processing unit.

FIG. 10 is a block diagram of the coin processing unit.

A control unit 171 for controlling the coin processing unit receives signals from the dispensing recognition unit 122, lock detection unit 156, open/close detection unit 162, dispensing box attachment detection unit 166, etc., to control the coin storing and feeding units 112, transport unit 113, wrapping unit 114, lock driving unit 155, open/close driving unit 159, etc.

Further, the control unit 171 has a function by which, in a dispensing mode for dispensing coins in the coin storing and feeding units 112 to the dispensing box 115, coins are fed from the coin storing and feeding units 112 in a state where the dispensing box 115 attached to the dispensing box attachment unit 116 is locked by the locking mechanism 151, the fed coins are transported by the transport unit 113, recognized by the dispensing recognition unit 122 and sent to the dispensing box 115, the locking by the locking mechanism 151 is cancelled if the coins for dispensing sent to the dispensing box 115 are recognized as normal coins by the dispensing recognition unit 122, and the bottom plate 132 of the dispensing box 115 is opened by the opening/closing mechanism 152 if, among the sent coins, an abnormal coin is recognized by the dispensing recognition unit 122.

Furthermore, the control unit 171 has a function by which, in a collection mode for collecting coins from the coin storing and feeding units 112 into the collection unit 117, the bottom plate 132 of the dispensing box 115 is opened by the opening/closing mechanism 152 in a state where the dispensing box 115 attached to the dispensing box attachment unit 116 is locked by the locking mechanism 151, coins are fed from the coin storing and feeding units 112, and the fed coins are transported by the transport unit 113 and sent to the dispensing box 115.

Next, operation of the coin processing unit will be described.

In the dispensing mode, the dispensing box 115 is locked to the dispensing box attachment unit 116 by the locking mechanism 151 if the dispensing box attachment detection unit 166 detects that the dispensing box 115 is attached to the dispensing box attachment unit 116. That is, as shown in FIG. 8, by driving of the lock driving unit 155, the lock member 154 is moved from the unlocking position upward to the locking position, and the lock portion 153 of the lock member 154 is inserted in the lock hole 137 of the dispensing box 115. Thus, the dispensing box 115 is locked so as to be prevented from being detached from the dispensing box attachment unit 116, the lock portion 153 abuts the abutting portion 142 of the latch body 139 in the dispensing box 115, the latch body 139 is pushed up against biasing of the coil spring 141, the latch portion 140 of the latch body 139 is pulled out upward from the latch hole 134 of the bottom plate 132, and the bottom plate 132 is unlatched. Accordingly, latching of the bottom plate 132 by the latch body 139 is cancelled in conjunction with locking of the dispensing box 115 by the locking mechanism 151, and the bottom plate 132 is permitted to be opened.

The opening/closing member 160 moves upward integrally with the lock member 154 moving upward to the locking position, the connecting portion 161 of the opening/closing member 160 is inserted in the connection hole 135 of the bottom plate 132 located at the closing position of the dispensing box 115, and the opening/closing member 160 and the bottom plate 132 are connected to each other.

Then, with the dispensing box 115 locked, coins for dispensing are successively fed from the coin storing and feeding units 112 in accordance with a dispensing instruction, and the fed coins are transported forward by the transport unit 113, recognized by the dispensing recognition unit 122, sent to the dispensing box 115, and pooled on the bottom plate 132 of the dispensing box 115.

If coins for dispensing sent to the dispensing box 115 are recognized as normal coins by the dispensing recognition unit 122, locking of the dispensing box 115 by the locking mechanism 151 is cancelled. That is, by driving of the lock driving unit 155, the lock member 154 is moved from the locking position downward to the unlocking position, and the lock port ion 153 of the lock member 154 is pulled out of the lock hole 137 of the dispensing box 115. Thus, pushing-up of the latch body 139 in the dispensing box 115 by the lock portion 153 of the lock member 154 is cancelled, the latch body 139 descends by biasing of the coil spring 141, the latch portion 140 of the latch body 139 is inserted in the latch hole 134 of the bottom plate 132 from above, and the bottom plate 132 is latched. Accordingly, the bottom plate 132 is latched in the closing position of closing the bottom of the box body 131 by the latch body 139 in conjunction with cancelling locking of the dispensing box 115 by the locking mechanism 151, and the bottom plate 132 is prevented from being opened.

The opening/closing member 160 moves downward integrally with the lock member 154 moving downward to the unlocking position, the connecting portion 161 of the opening/closing member 160 is pulled out of the connection hole 135 of the bottom plate 132 located at the closing position of the dispensing box 115, and connection between the opening/closing member 160 and the bottom plate 132 is cancelled.

The lock member 154 and the opening/closing member 160 thus descends, so that the dispensing box 115 storing coins therein can be taken out from the dispensing box attachment unit 116. Coins in the dispensing box 115 can be taken out by detaching the dispensing box 115 from the dispensing box attachment unit 116. After coins are taken out, the dispensing box 115 is returned to the dispensing box attachment unit 116.

Additionally, if, among coins for dispensing fed from the coin storing and feeding units 112, an abnormal coin such as a coin of a denomination different from a dispensing denomination or an extra coin over the number of coins for dispensing is recognized by the dispensing recognition unit 122, for example, in the process of sending the coins to the dispensing box 115, the bottom plate 132 of the dispensing box 115 is opened by the opening/closing mechanism 152 with the dispensing box 115 locked. That is, as shown in FIG. 9, by driving of the open/close driving unit 159, the unlatched bottom plate 132 of the dispensing box 115 is slid backward to the opening position integrally with the sliding member 158 and the opening/closing member 160, and a bottom of the dispensing box 115 is opened. Thus, coins pooled in the dispensing box 115 drop to be collected in the collection unit 117.

Thereafter, as shown in FIG. 8, by driving of the open/close driving unit 159, the bottom plate 132 is slid forward to the closing position integrally with the sliding member 158 and the opening/closing member 160, and the bottom of the dispensing box 115 is closed.

Then, coins for dispensing are successively fed again from the coin storing and feeding units 112 in accordance with the dispensing instruction, and the fed coins are transported forward by the transport unit 113, recognized by the dispensing recognition unit 122, sent to the dispensing box 115, and pooled on the bottom plate 132 of the dispensing box 115. If the coins for dispensing sent to the dispensing box 115 are recognized as normal coins by the dispensing recognition unit 122, locking of the dispensing box 115 by the locking mechanism 151 is cancelled as described above.

In the collection mode, if the dispensing box attachment detection unit 166 detects that the dispensing box 115 is attached to the dispensing box attachment unit 116, the dispensing box 115 is locked to the dispensing box attachment unit 116 by the locking mechanism 151. As described above, with this lock operation, the bottom plate 132 of the dispensing box 115 is unlatched, and the opening/closing member 160 is connected to the bottom plate 132 of the dispensing box 115. As described above, the bottom plate 132 of the dispensing box 115 is opened by the opening/closing mechanism 152 with the dispensing box 115 locked. Thus, the inner space of the box body 131 of the dispensing box 115, for which the bottom plate 132 is opened, is formed into a part of the collection route 143 for collecting coins from the coin storing and feeding units 112 into the collection unit 117.

Coins are fed from the coin storing and feeding units 112, and the fed coins are transported by the transport unit 113, recognized by the dispensing recognition unit 122 and sent to the dispensing box 115. The coins sent to the dispensing box 115 are collected in the collection unit 117 through the dispensing box 115.

After coins in the coin storing and feeding units 112 are collected in the collection unit 117, the bottom plate 132 is slid forward to the closing position integrally with the sliding member 158 and opening/closing member 160 and the bottom of the dispensing box 115 is closed.

As described above, in the coin processing unit, coins are fed from the coin storing and feeding units 112 in a state where the dispensing box 115 attached to the dispensing box attachment unit 116 is locked, the fed coins are transported by the transport unit 113, recognized by the dispensing recognition unit 122 and sent to the dispensing box 115, and if the coins for dispensing sent to the dispensing box 115 are recognized as normal coins, the dispensing box 115 is unlocked, the dispensing box 115 is detached from the dispensing box attachment unit 116 and the coins can be taken out. If an abnormal coin is recognized, the bottom plate 132 of the dispensing box 115 is opened by the opening/closing mechanism 152 with the dispensing box 115 locked, and coins dropping from the dispensing box 115 can be collected in the collection unit 117. Thus, the dispensing box 115 can have a function of escrowing coins, no dispensing escrow unit is required, and downsizing and cost reduction can be realized. Additionally, since a conventional work of transporting coins from a dispensing escrow unit to a dispensing box is not required, the processing time for dispensing coins can be shortened. Further, since an abnormal coin, which is mixed in normal coins in the dispensing box 115, can be collected in the collection unit 117, the dispensing box 115, in which an abnormal coin is mixed in normal coins, can be prevented from being taken out.

Since the dispensing box 115, for which the bottom plate 132 is opened, forms a part of the collection route 143 for collecting coins from the coin storing and feeding units 112 into the collection unit 117, part of the collection route 143 can be used in common with a dispensing route for dispensing coins to the dispensing box 115 and the collection route 143 can be simplified in constitution.

In the collection mode for collecting coins from the coin storing and feeding units 112 into the collection unit 117, the bottom plate 132 of the dispensing box 115 is opened in a state where the dispensing box 115 attached to the dispensing box attachment unit 116 is locked, coins are fed from the coin storing and feeding units 112, and the fed coins are transported to the dispensing box 115 by the transport unit 113, and thus coins, which pass through the dispensing box 115, can be collected in the collection unit 117 and the processing time for collecting coins can be shortened.

The bottom plate 132 is latched, by the latching mechanism 138 of the dispensing box 115, in the closing position of closing the bottom of the box body 131 in conjunction with cancelling locking of the dispensing box 115 by the locking mechanism 151, and the bottom plate 132 can be unlatched by the latching mechanism 138 of the dispensing box 115 in conjunction with locking of the dispensing box 115 by the locking mechanism 151. Thus, the bottom plate 132 of the dispensing box 115 detached from the machine body 111 can be prevented from being opened, the locking mechanism 151 can be used for both locking of the dispensing box 115 and unlocking of the bottom plate 132, and the mechanism can be simplified in constitution.

Figure 11:
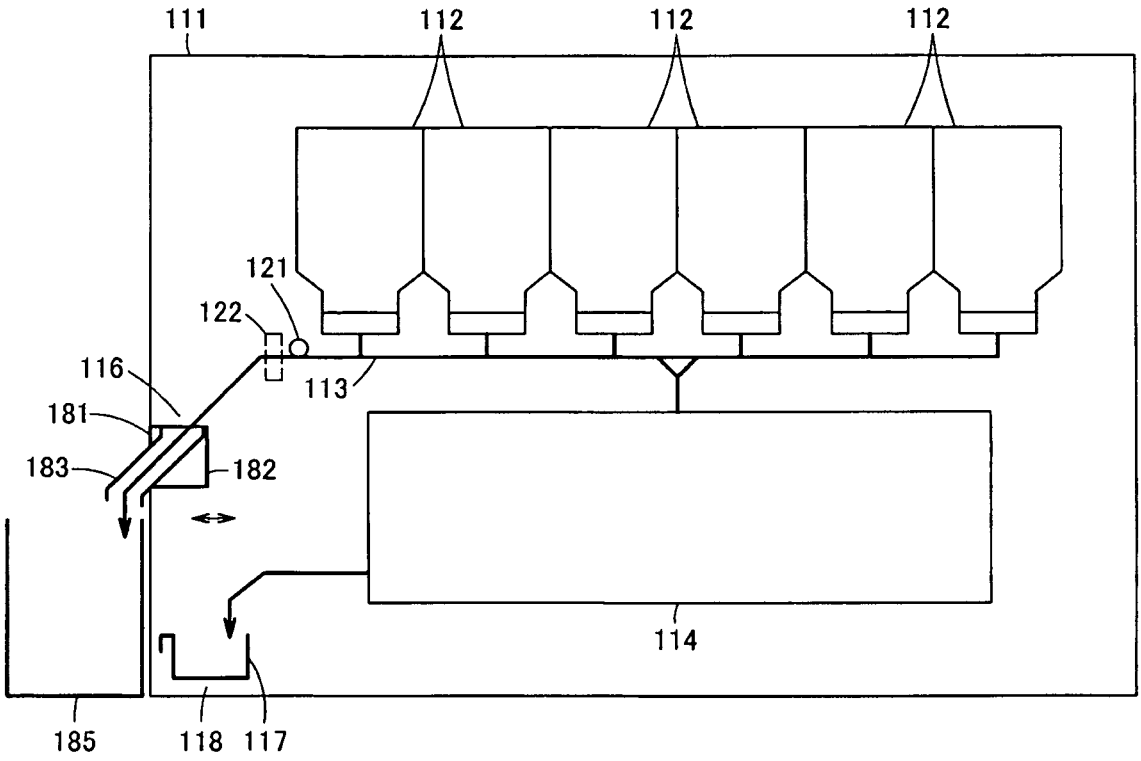
FIG. 11 is a right side view showing a schematic structure of the coin processing unit to which a dispensing box with chute for outside collection is attached.

Moreover, coins in the coin storing and feeding units 112 are directly taken out of the coin processing unit, and can be collected not in the collection unit 117 in the coin processing unit but outside the coin processing unit. In this case, as shown in FIG. 11, the dispensing box 115 is detached from the dispensing box attachment unit 116, and a dispensing box with chute for outside collection 181 is attached to the dispensing box attachment unit 116.

The dispensing box with chute for outside collection 181 has a box body 182 which has approximately same shape as that of the box body 131 of the dispensing box 115 and can be attached to and detached from the dispensing box attachment unit 116, and a chute for outside collection 183 for guiding coins, which are sent from the transport unit 113, to a front part of the machine body 111 and dispensing them with the box body 182 attached to the dispensing box attachment unit 116. A lock hole (not shown) similar to the lock hole 137 of the dispensing box 115 is formed in the box body 182.

When coins in the coin storing and feeding units 112 are directly taken out of the coin processing unit and collected not in the collection unit 117 in the coin processing unit but outside the coin processing unit, the dispensing box 115 is detached from the dispensing box attachment unit 116, and the dispensing box with chute for outside collection 181 is attached to the dispensing box attachment unit 116. A collection box 185 is arranged under the chute for outside collection 183.

Moreover, an outside collection mode may be set separately from the above-described normal collection mode. In the normal collection mode, when attachment of the dispensing box with chute for outside collection 181 is detected by the dispensing box attachment detection unit 166, the dispensing box with chute for outside collection 181 is locked to the dispensing box attachment unit 116 by the locking mechanism 151 and then opening/closing mechanism 152 is operated. In this case, the dispensing box with chute for outside collection 181 is formed in advance so as not to interfere with the operation of the opening/closing mechanism 152. If the outside collection mode is set, when attachment of the dispensing box with chute for outside collection 181 is detected by the dispensing box attachment detection unit 166, the dispensing box with chute for outside collection 181 is locked to the dispensing box attachment unit 116 by the locking mechanism 151, however, the opening/closing mechanism 152 is not operated.

After the dispensing box with chute for outside collection 181 is locked, coins are fed from the coin storing and feeding units 112, and the fed coins are transported by the transport unit 113, recognized by the dispensing recognition unit 122 and sent to the dispensing box with chute for outside collection 181. The coins sent to the dispensing box with chute for outside collection 181 are guided to the front part of the machine body 111 through the chute for outside collection 183, dispensed, and collected in the collection box 185.

The dispensing box with chute for outside collection 181 is thus attached to the dispensing box attachment unit 116 from which the dispensing box 115 is detached, and thus coins sent to the dispensing box with chute for outside collection 181 are sent outside the machine body and can be collected.

Moreover, the dispensing box with chute for outside collection 181 can be used for, in addition to the outside collection mode, a counting mode in which coins put in the machine body are recognized and counted by a recognition unit of the depositing mechanism and then taken out of the machine body without being deposited.

What is claimed is:

1. A coin processing unit for processing coins, comprising:

a machine body;

a wrapping unit which is arranged in a lower region in the machine body, and wraps and forms a predetermined number of stacked coins into a coin-roll;

a dispensing box receiving coins for dispensing;

a coin storing and feeding unit which is arranged by denomination, and is configured to store coins, which are received in the machine body, and feeds the stored coins one by one;

a transport unit transporting the coins fed from the coin storing and feeding unit to the dispensing box at the time of dispensing coins, and transporting the coins fed from the coin storing and feeding unit to the wrapping unit at the time of wrapping coins;

a coin-roll storing and sending unit which is arranged by denomination, and which stores and sends coin-roils formed by the wrapping unit; and a coin-roll outlet for dispensing coin-rolls sent from the coin-roll storing and sending unit;

wherein the coin storing and feeding unit and the coin-roll storing and sending unit are arranged above the wrapping unit.

2. The coin processing unit according to claim 1, wherein the coin storing and feeding unit is arranged along a depth direction of the machine body side by side by denomination, the coin-roll storing and sending unit aligns and stores a plurality of coin-rolls along the depth direction of the machine body, and the coin storing and feeding unit and the coin-roll storing and sending unit are arranged side by side in a width direction of the machine body.

3. The coin processing unit according to claim 1, wherein the coin storing and feeding unit includes a coin storing unit for storing coins and a coin feeding unit for feeding coins from a lower part of the coin storing unit.

4. The coin processing unit according to claim 1, comprising a coin-roll transport unit which is arranged in front of the wrapping unit and the coin-roll storing and sending unit and transports coin-rolls formed by the wrapping unit to the coin-roll storing and sending unit.

5. The coin processing unit according to claim 1, comprising:

a coin receiving and processing unit which is arranged in an upper region in the machine body, and recognizes coins received from the outside of the machine body; and a depositing escrow unit which is arranged under the coin receiving and processing unit and above the coin storing and feeding unit, escrows coins recognized by the coin receiving and processing unit, and ejects the escrowed coins to the coin storing and feeding unit for storing.

6. The coin processing unit according to claim 1, wherein the wrapping unit includes:

a centrifugal disk for wrapping for receiving coins, which are fed from the coin storing and feeding unit, and feeding the received coins one by one;

a coin passage for transporting coins fed one by one from the centrifugal disk for wrapping;

a stacking unit for successively stacking coins, which are transported through the coin passage for wrapping, upward; and a wrapping mechanism for wrapping and forming a predetermined number of coins, which are stacked in the stacking unit, into a coin-roll.

7. The coin processing unit according to claim 6, wherein the centrifugal disk for wrapping of the wrapping unit is arranged under the coin storing and feeding unit, and the stacking unit and the wrapping mechanism are arranged under the coin-roll storing and sending unit.

8. The coin processing unit according to claim 1, wherein the dispensing box includes a box body, which opens vertically, and a bottom plate for opening/closing a bottom of the box body, the coin processing unit further comprising:

a dispensing recognition unit for recognizing coins transported by the transport unit;

a dispensing box attachment unit to which the dispensing box can be attached to and detached from, and receives coins recognized by the dispensing recognition unit and sent by the transport unit;

a locking mechanism for locking the dispensing box attached to the dispensing box attachment unit;

an opening/closing mechanism for opening/closing the bottom plate of the dispensing box attached to the dispensing box attachment unit;

a collection unit for collecting coins which are dropped by opening of the bottom plate of the dispensing box; and a control unit for allowing coins to be fed from the coin storing and feeding unit in a state where the dispensing box attached to the dispensing box attachment unit is locked by the locking mechanism, allowing the fed coins to be transported by the transport unit, recognized by the dispensing recognition unit and sent to the dispensing box, allowing locking by the locking mechanism to be cancelled when the coins for dispensing sent to the dispensing box are recognized as normal coins by the dispensing recognition unit, and allowing the bottom plate of the dispensing box to be opened by the opening/closing mechanism when, among the sent coins, an abnormal coin is recognized by the dispensing recognition unit.

9. The coin processing unit according to claim 8, wherein the dispensing box, the bottom plate of which is opened, forms a part of a collection route for collecting coins from the coin storing and feeding unit into the collection unit.

10. The coin processing unit according to claim 9, wherein, when coins in the coin storing and feeding unit are collected in the collection unit, the control unit allows the bottom plate of the dispensing box to be opened by the opening/closing mechanism in a state where the dispensing box attached to the dispensing box attachment unit is locked by the locking mechanism, allows coins to be fed from the coin storing and feeding unit, and allows the fed coins to be transported by the transport unit and sent to the dispensing box.

11. The coin processing unit according to claim 8, wherein the dispensing box has a latching mechanism for latching the bottom plate in a closing position of closing a bottom of the box body in conjunction with cancelling locking of the dispensing box by the locking mechanism, or unlatching the bottom plate in conjunction with locking of the dispensing box by the locking mechanism.

12. The coin processing unit according to claim 8, wherein a dispensing box with chute for outside collection for sending coins, which are sent to the dispensing box attachment unit, outside the machine body can be attached to the dispensing box attachment unit from which the dispensing box is detached.

* * * * *